US009975022B2

(12) United States Patent
Boggs

(10) Patent No.: US 9,975,022 B2
(45) **Date of Patent: *May 22, 2018**

(54) GOLF CLUB WITH WEIGHT RECEIVING POLYMERIC INSERT

(71) Applicant: Karsten Manufacturing Corporation, Phoenix, AZ (US)

(72) Inventor: Joshua Boggs, Aledo, TX (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/198,878

(22) Filed: Jun. 30, 2016

(65) Prior Publication Data

US 2016/0310809 A1 Oct. 27, 2016

Related U.S. Application Data

(63) Continuation-in-part of application No. 14/493,403, filed on Sep. 23, 2014, now Pat. No. 9,381,406.

(60) Provisional application No. 62/015,092, filed on Jun. 20, 2014.

(51) Int. Cl.

| | |
|---|---|
| ***A63B 53/06*** | (2015.01) |
| ***A63B 60/02*** | (2015.01) |
| ***A63B 53/04*** | (2015.01) |
| *A63B 71/06* | (2006.01) |
| *A63B 60/54* | (2015.01) |

(52) U.S. Cl.

CPC ..... *A63B 60/02* (2015.10); *A63B 53/0466* (2013.01); *A63B 53/06* (2013.01); *A63B 53/04* (2013.01); *A63B 60/54* (2015.10); *A63B 2053/042* (2013.01); *A63B 2053/045* (2013.01); *A63B 2053/0408* (2013.01); *A63B 2053/0412* (2013.01); *A63B 2053/0433* (2013.01); *A63B 2053/0454* (2013.01); *A63B 2053/0491* (2013.01); *A63B 2071/0694* (2013.01); *A63B 2209/00* (2013.01); *A63B 2209/02* (2013.01)

(58) Field of Classification Search

CPC ..... A63B 2053/042; A63B 2053/0491; A63B 2053/0433; A63B 2053/0412; A63B 2053/0454; A63B 2053/045; A63B 53/04; A63B 53/06; A63B 2053/0408

USPC ..... 473/346, 334, 335, 336, 337, 344, 345, 473/349, 350, 324

See application file for complete search history.

(56) References Cited

U.S. PATENT DOCUMENTS

| | | | |
|---|---|---|---|
| 4,241,115 | A | 12/1980 | Temin |
| 7,108,609 | B2 | 9/2006 | Stites et al. |
| 7,354,355 | B2 | 4/2008 | Tavares et al. |
| 7,419,441 | B2 | 9/2008 | Hoffman et al. |
| 7,938,739 | B2 | 5/2011 | Cole |
| 7,988,568 | B2 | 8/2011 | Stites et al. |
| 8,062,151 | B2 | 11/2011 | Boyd et al. |
| 8,235,843 | B1 | 8/2012 | Rice et al. |
| 8,435,135 | B2 | 5/2013 | Stites |
| 8,579,724 | B2 | 11/2013 | Evans |
| 8,591,352 | B2 | 11/2013 | Hirano |

(Continued)

*Primary Examiner* — Benjamin Layno

(57) ABSTRACT

A golf club head includes a first portion that is rigidly adhered to a second portion to at least partially define an interior club head volume. The first portion is formed from a metallic material and includes a face, and the second portion is formed from a polymeric material and defines a bore that is configured to receive and to selectively retain an elongate weight.

16 Claims, 8 Drawing Sheets

(56) References Cited

U.S. PATENT DOCUMENTS

| | | | | |
|---|---|---|---|---|
| 8,777,774 | B1 * | 7/2014 | Kim | A63B 53/06 473/334 |
| 9,381,406 | B2 * | 7/2016 | Boggs | A63B 53/04 |
| 2002/0065144 | A1 | 5/2002 | Helmstetter et al. | |
| 2002/0137576 | A1 | 9/2002 | Dammen | |
| 2003/0036441 | A1 | 2/2003 | Vincent et al. | |
| 2003/0125129 | A1 | 7/2003 | Saksun, Sr. | |
| 2004/0176177 | A1 | 9/2004 | Mahaffey et al. | |
| 2010/0099511 | A1 | 4/2010 | Stites et al. | |
| 2010/0331100 | A1 | 12/2010 | Tavares et al. | |
| 2011/0294589 | A1 * | 12/2011 | Stites | A63B 53/0466 473/290 |
| 2012/0034992 | A1 | 2/2012 | Boyd et al. | |
| 2012/0135819 | A1 * | 5/2012 | Uetz | A63B 53/0466 473/331 |
| 2012/0165115 | A1 | 6/2012 | Matsunaga | |
| 2013/0040755 | A1 | 2/2013 | Stites et al. | |
| 2013/0130828 | A1 | 5/2013 | Stites et al. | |
| 2014/0018184 | A1 | 1/2014 | Bezilla et al. | |
| 2014/0106896 | A1 | 4/2014 | Bennett et al. | |

* cited by examiner

GOLF CLUB WITH WEIGHT RECEIVING POLYMERIC INSERT

CROSS REFERENCE TO RELATED APPLICATIONS

This application is a continuation-in-part of U.S. patent application Ser. No. 14/493,403, filed on Sep. 23, 2014, now U.S. Pat. No. 9,381,406, which claims the benefit of priority from U.S. Provisional Patent Application No. 62/015,092, filed Jun. 20, 2014, which are both hereby incorporated by reference in their entirety.

TECHNICAL FIELD

The present invention relates generally to golf clubs and golf club heads, and, in particular, to golf clubs and golf club heads having reconfigurable weight parameters.

BACKGROUND

A golf club is generally formed by affixing a club head to a first end of a flexible shaft, and affixing a grip member to a second end of the shaft. Convention and the USGA Rules of Golf have established certain terminology to describe different portions and angular relationships of a club head. For example, a wood-type club head includes a face or striking face, a crown, a sole, a heel, a toe, a back, and a hosel. These club head portions are most easily described when the club head is positioned in a reference position relative to a ground plane. In the reference position, the lie angle of the club (i.e., the angle formed between the shaft and the ground plane) and the loft angle of the club (i.e., the angle formed between the face and the ground plane) are oriented as specified by the manufacturer.

The sole of the club head is generally disposed on an opposite side of the club head from the crown, and is further disposed on an opposite side of the club head from the shaft. When in the reference position, the sole of the club head is intended to contact the ground plane. For the portion of the club that is to the rear of the face, the crown may be separated from the sole at the point on the club head where the surface tangent of the club head is normal to the ground plane.

The hosel is the portion of the club head that is intended to couple the club head with the shaft. The hosel includes an internal bore that is configured to receive the shaft or a suitable shaft adapter. In a configuration where the shaft is directly inserted into the hosel, the hosel bore may have a center hosel-axis that is substantially coincident with a center longitudinal-axis of the shaft. For club head embodiments including a shaft adapter, the shaft may be received in a suitable shaft adapter bore that has a center adapter-axis, which may be substantially coincident with the shaft axis. The shaft adapter-axis may be offset angularly and/or linearly from the hosel-axis to permit adjustment of club parameters via rotation of the shaft adapter with respect to the club head, as is known by persons skilled in the art.

The heel may be defined as the portion of the club head that is proximate to and including the hosel. Conversely, the toe may be the area of the golf club that is the farthest from the shaft. Finally, the back of the club head may be the portion of the club head that is generally opposite the face.

Two key parameters that affect the performance and forgiveness of a club include the magnitude and location of the club head's center of gravity (COG) and the various moments of inertia (MOI) about the COG. The club's moments of inertia relate to the club's resistance to rotation (particularly during an off-center hit). These are often perceived as the club's measure of "forgiveness." In typical driver designs, high moments of inertia are desired to reduce the club's tendency to push or fade a ball. Achieving a high moment of inertia generally involves placing mass as close to the perimeter of the club as possible (to maximize the moment of inertia about the center of gravity), and as close to the toe as possible (to maximize a separate moment of inertia about the shaft).

While the various moments of inertia affect the forgiveness of a club head, the location of the center of gravity can also affect the trajectory of a shot for a given face loft angle. For example, a center of gravity that is positioned as far rearward (i.e., away from the face) and as low (i.e., close to the sole) as possible typically results in a ball flight that has a higher trajectory than a club head with a center of gravity placed more forward and/or higher.

While a high moment of inertia is obtained by increasing the perimeter weighting of the club head, an increase in the total mass/swing weight of the club head (i.e., the magnitude of the center of gravity) has a strong, negative effect on club head speed and hitting distance. Said another way, to maximize club head speed (and hitting distance), a lower total mass is desired; however, a lower total mass generally reduces the club head's moment of inertia (and forgiveness).

The desire for a faster swing speed (i.e., lower mass) and greater forgiveness (i.e., larger MOI or specifically placed COG) presents a difficult optimization problem. These competing constraints explain why most drivers/woods are formed from hollow, thin-walled bodies, with nearly all of the mass being positioned as far from the COG as possible (i.e., to maximize the various MOI's). Additionally, removable/interchangeable weights have been used to alter other dynamic, swing parameters and/or to move the COG. Therefore, the total of all club head mass is the sum of the total amount of structural mass and the total amount of discretionary mass. Typical driver designs generally have a total club head mass of from about 195 g to about 215 g.

Structural mass generally refers to the mass of the materials that are required to provide the club head with the structural resilience needed to withstand repeated impacts. Structural mass is highly design-dependent, and provides a designer with a relatively low amount of control over specific mass distribution.

Discretionary mass is any additional mass (beyond the minimum structural requirements) that may be added to the club head design for the sole purpose of customizing the performance and/or forgiveness of the club. In an ideal club design, for a constant total swing weight, the amount of structural mass would be minimized (without sacrificing resiliency) to provide a designer with additional discretionary mass to customize club performance.

While this provided background description attempts to clearly explain certain club-related terminology, it is meant to be illustrative and not limiting. Custom within the industry, rules set by golf organizations such as the United States Golf Association (USGA) or the R&A, and naming convention may augment this description of terminology without departing from the scope of the present application.

SUMMARY

A golf club head includes a first portion that is rigidly adhered to a second portion to at least partially define an interior club head volume. The first portion is formed from a metallic material and includes a face, and the second portion is formed from a polymeric material and defines a bore that is configured to receive and to selectively retain an elongate weight. In further embodiments, at least one stiffening feature may extend from a wall that defines a bore to aid in reinforcing the second portion. This stiffening feature may be adhered to the first portion to aid in attachment.

The above features and advantages and other features and advantages of the present invention are readily apparent from the following detailed description of the best modes for carrying out the invention when taken in connection with the accompanying drawings.

DETAILED DESCRIPTION

The present technology generally relates to a golf club head that is formed by permanently/rigidly joining a first, metallic portion to a second, polymeric portion to at least partially define an interior volume of the club head. The second, polymeric portion is operative to reduce the overall structural weight of the club head, though further defines a bore that is configured to receive and to selectively retain an elongate weight. This head design may be particularly useful in a wood-style head, such as a driver, fairway wood, or hybrid iron.

Figure 1:
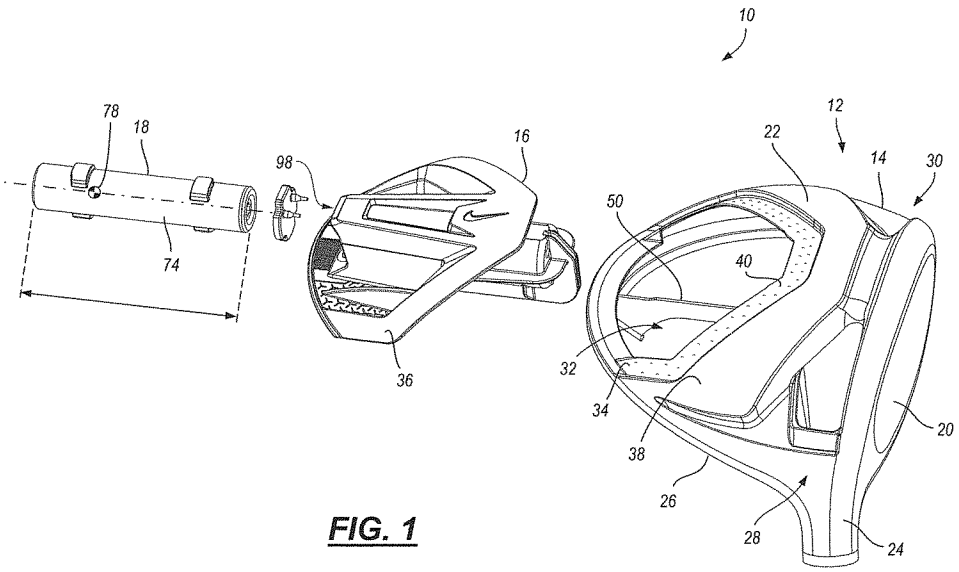
FIG. 1 is a schematic exploded perspective view of a golf club head having a polymeric insert.

Referring to the drawings, wherein like reference numerals are used to identify like or identical components in the various views, FIGS. 1-16 schematically illustrate a first embodiment of the present design. Specifically, FIG. 1 illustrates an exploded perspective view 10 of a golf club head 12 that includes a first, body portion 14 ("body 14") and a second, insert portion 16 ("insert 16"). The body 14 and insert 16 may be secured together to define a closed, interior club head volume. One or more weights 18 may be selectively coupled with the body 14 and/or insert 16 to provide a user with an ability to alter the stock performance and weight distribution of the club head 12.

As shown, the body 14 includes a face 20, a sole 22, a hosel 24, and a crown 26 (i.e., where the crown 26 is disposed on an opposite side of the club head 12 from the sole 22). A heel portion 28 may generally be defined on a first side of the face 20, and may include the hosel 24. Likewise, a toe portion 30 may generally be defined on an opposite side of the face 20 from the heel portion 28.

The body 12 may be formed through any suitable manufacturing process that may be used to form a substantially hollow body. In the illustrated embodiment, the body 14 may be formed from a metal alloy using processes such as stamping, casting, molding, and/or forging. The body 14 may be either a single unitary component, or may comprise various subcomponents that may subsequently be fused together. Examples of suitable light-weight metal alloys may include, for example, stainless steel (e.g., AISI type 304 or AISI type 630 stainless steel), titanium alloys (e.g., a Ti-6Al-4V or Ti-8Al-1Mo-1V Titanium alloy), amorphous metal alloys, or other similar materials.

Figure 2:
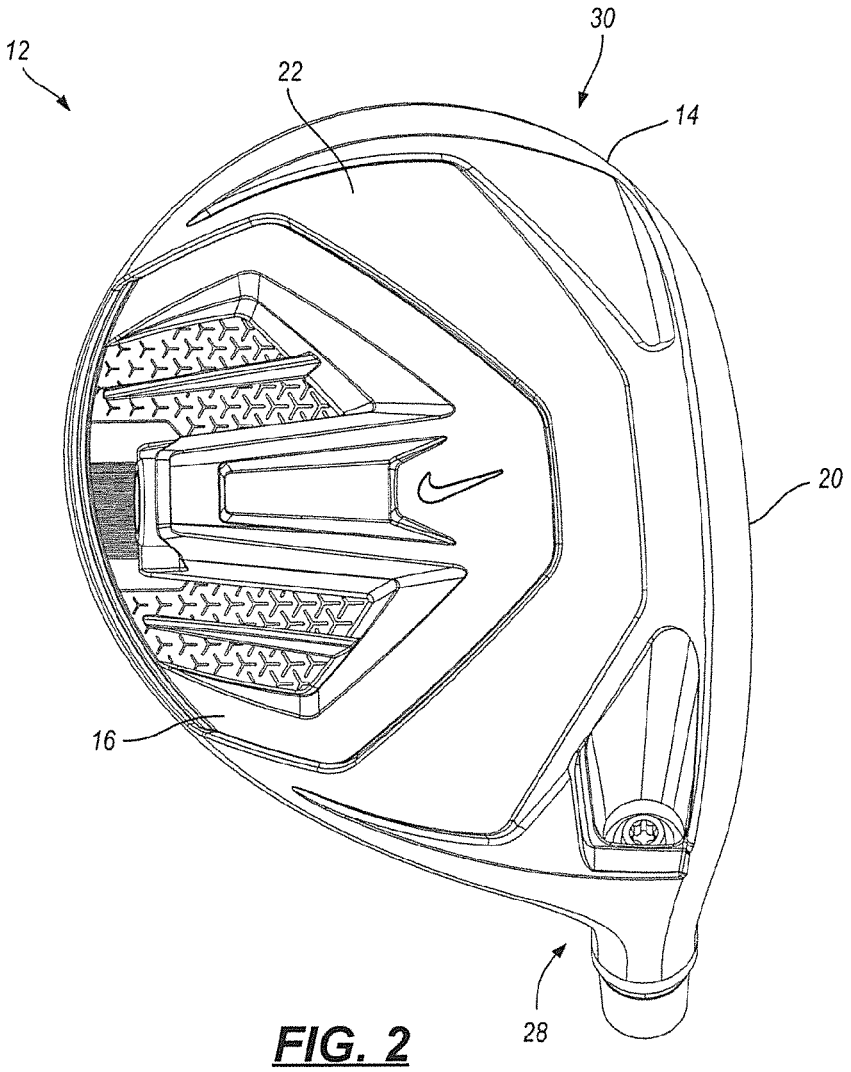
FIG. 2 is a schematic bottom view of the golf club head provided in FIG. 1.

The body 14 may define an opening 32 that is adapted to receive the insert 14. In one configuration, the opening 32 may be provided entirely in the sole 22, however, in other configurations, the opening 32 may also extend to include a portion of the crown 26. As generally shown in FIG. 2, the insert 16 may be secured to the body 14 such that it entirely covers the opening 32 and such that the two components cooperate to form the internal volume.

To reduce structural mass beyond what is economically viable with metal alloys, the insert 16 may be formed from a polymeric material that is affixed to the body 14 in a manner to withstand repeated shock/impact loadings. The comparatively low density nature of polymeric materials also permits greater design flexibility, at less of a structural weight penalty, than similar designs made from metal. In one configuration, the desired design flexibility may be achieved by molding the polymeric material into shape using a molding technique, such as, injection molding, compression molding, blow molding, thermoforming or the like. To provide the maximum design flexibility, the preferred molding technique is injection molding.

While weight savings and design flexibility are important, the polymeric material must still be strong enough to withstand the stress that is experienced when the club head 12 impacts a ball. This may be accomplished through a combination of structural and material design choices. With regard to material selection, it is preferable to use a moldable polymeric material that has a tensile strength of greater than about 180 MPa (according to ASTM D638), or more preferably greater than about 220 MPa.

In one embodiment, the insert 16 may be formed from a polymeric material that comprises a resin and a plurality of discontinuous fibers (i.e., "chopped fibers"). The discontinuous/chopped fibers may include, for example, chopped carbon fibers or chopped glass fibers and are embedded within the resin prior to molding the insert 16. In one configuration, the polymeric material may be a "long fiber thermoplastic" where the discontinuous fibers are embedded in a thermoplastic resin and each have a designed fiber length of from about 3 mm to about 12 mm. In another configuration, the polymeric material may be a "short fiber thermoplastic" where the discontinuous fibers are similarly embedded in a thermoplastic resin, though may each have a designed length of from about 0.01 mm to about 3 mm. In either case, the fiber length may be affected by the molding process, and due to breakage, a portion of the fibers may be shorter than the described range. Additionally, in some configurations, discontinuous chopped fibers may be characterized by an aspect ratio (e.g., length/diameter of the fiber) of greater than about 10, or more preferably greater than about 50, and less than about 1500. Regardless of the specific type of discontinuous chopped fibers used, the material may have fibers with lengths of from about 0.01 mm to about 12 mm and a resin content of from about 40% to about 90% by weight, or more preferably from about 55% to about 70% by weight.

One suitable material may be a thermoplastic polyamide (e.g., PA6 or PA66) filled with chopped carbon fiber (i.e., a carbon-filled polyamide). Other resins may include certain polyimides, polyamide-imides, polyetheretherketones (PEEK), polycarbonates, engineering polyurethanes, and/or other similar materials By replacing a portion of the body 14 with a comparatively lighter polymeric insert 16, either the entire weight of the club head 12 may be reduced (which may provide faster club head speeds and/or longer hitting distances), or alternatively, the ratio of discretionary weight to structural weight may be increased (i.e., for a constant club head weight). Additionally, because polymeric molding techniques are generally capable of forming more intricate and/or complex designs than traditional metal forming techniques, the use of a polymeric insert 16 may also provide greater freedom in styling the overall appearance of the club head.

Referring again to FIG. 1, the insert 16 may be affixed to the body 14 of the club head 12 using an adhesive that is selected to bond with both the metal body 14 and the polymer of the insert 16. Such an adhesive may include, for example, a two-part acrylic epoxy such as DP-810, available from the 3M Company of St. Paul, Minn. The adhesive may be disposed across a lap joint formed between the insert 16 and an outer bond surface 34 of the body 14 when assembled. In one configuration, the outer bond surface 34 may be at least partially recessed into the body 14 such that when the insert 16 is installed, an outer surface 36 of the insert 16 may either be substantially flush with an outer surface 38 of the sole 22, or else may be partially recessed relative to the outer surface 38 of the sole 22.

In one configuration, the bond surface 34 of the lap joint may include a plurality of embossed spacing features 40 disposed in a spaced arrangement across the surface 34. The spacing features 40 may include one or more bumps or ridges that are provided to ensure a uniform, minimum adhesive thickness between the body 14 and the insert 16. In one configuration, each of the plurality of spacing features 40 may protrude above the bond surface 34 by about 0.05 mm to about 0.50 mm.

While most adhesives will readily bond to metals, typical bond strengths to polymers are comparatively lower. Therefore, to improve the adhesive bonding with the polymer of the insert 16, the insert 16 may be pre-treated prior to assembly. In one configuration, such a pre-treatment may include a corona discharge or plasma discharge surface treatment, which may increase the surface energy of the polymer. In other embodiments, chemical adhesion promoters and/or mechanical abrasion may alternatively be used to increase the bond strength with the polymer.

While providing an opening 32 in the body 14 serves to reduce the weight of the club head 12, it also can negatively affect the structural integrity and/or durability of the club head 12 if not properly reinforced. Any flexure of the body 14 around the opening 32 may, for example, negatively affect the bond strength of the adhesive used to secure the insert 16 and/or the performance and durability of the club head 12. To replace some or all of the lost structural rigidity, one or more support struts or ribs 50 may extend across the opening 32 to stiffen the body structure.

Figure 3:
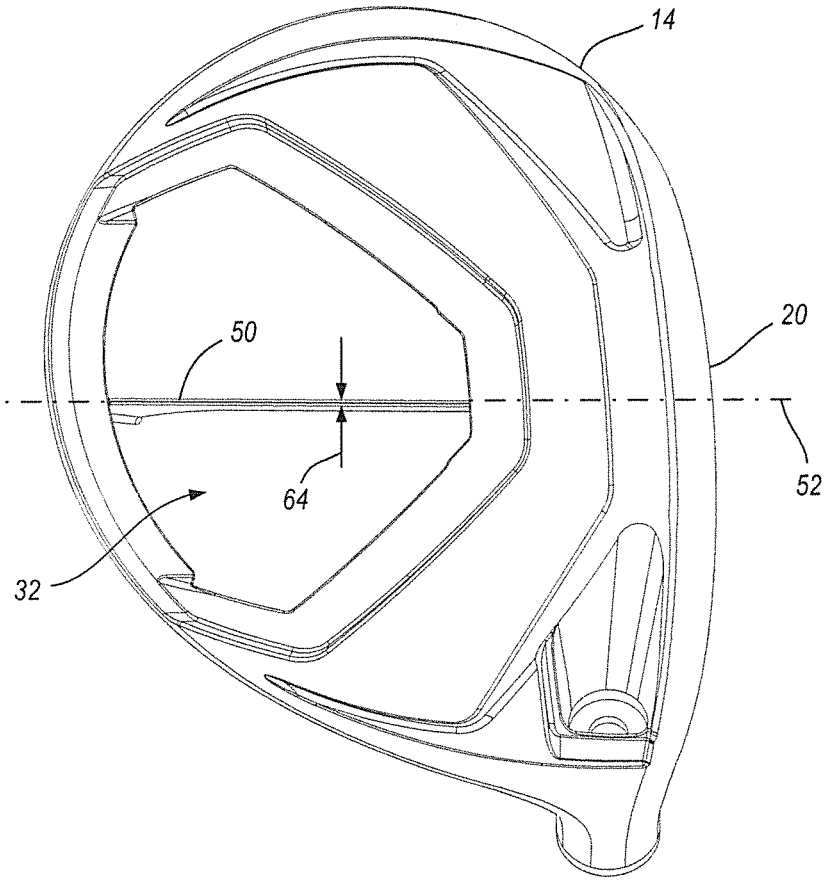
FIG. 3 is a schematic bottom view of a metallic body of a golf club head.

FIG. 3 schematically illustrates a club head body 14 with a single support strut/rib 50 extending across the opening 32. In this configuration, the strut 50 may be generally oriented along a longitudinal axis 52 that intersects the face 20 of the club head 12 (more clearly illustrated in FIG. 5). As used herein, when an axis "intersects" the face, it should be understood that the axis is not constrained to exist only on the described component, but instead extends linearly beyond the component as well.

Figure 4:
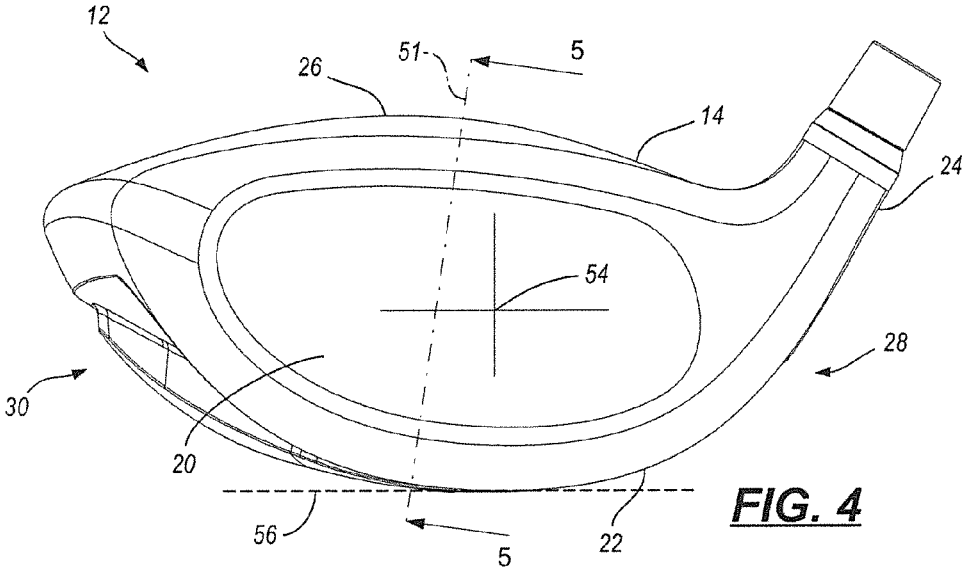
FIG. 4 is a schematic side view of the face of a golf club head.
Figure 5:
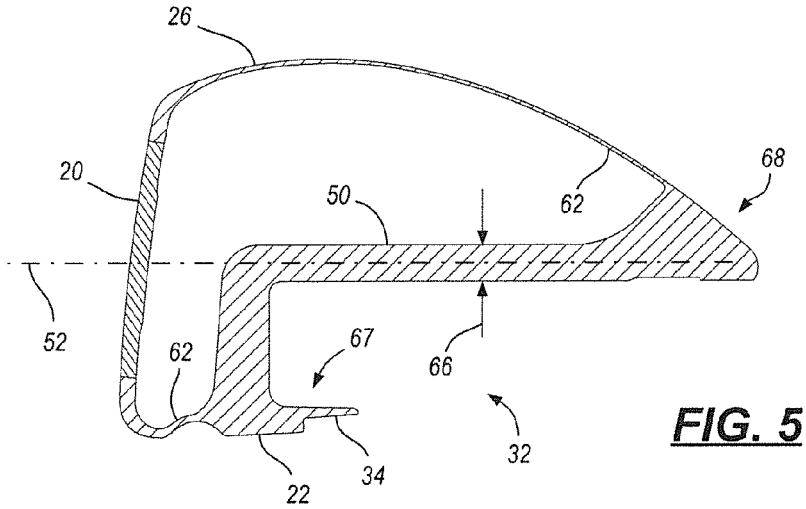
FIG. 5 is a schematic cross-sectional view of the golf club head of FIG. 4, taken along line 5-5.

FIG. 4 provides a face-view of the club head 12 provided in FIG. 3, with a bisecting strut-section taken along line 5-5, which is separately illustrated as FIG. 5. As shown in FIGS. 3-5, the strut 50 may be generally planar in nature, with the majority of the strut 50 being centered about and/or disposed within a common stiffening plane 51. In the illustrated embodiment, the stiffening plane is coincident with section 5-5 shown in FIG. 4. In one configuration, the stiffening plane 51 (and strut 50) may be about perpendicular to the wall of the club head 12 from which the strut/rib 50 extends. In other embodiments, the stiffening plane 51 may be disposed at an angle to the wall, or, for example, within 45 degrees of perpendicular. Said another way, the stiffening plane 51 may form an angle of from about 45 degrees to about 135 degrees with the wall from which the strut 50 extends. As shown in FIG. 4, in some configurations, the strut 50 may be offset relative to a face center 54, and may further be angled relative to a vertical plane (i.e., a plane that is perpendicular to the ground plane 56) extending through the face center 54 (i.e. face center as determined using Unites States Golf Association (USGA) standard measuring procedures and methods). In one configuration, the offset may be from about 0 mm to about 20 mm. Additionally, the angle formed between the strut 50 and the vertical plane may be from about 0 degrees to about 10 degrees.

Referring to FIG. 5, in one configuration, the strut 50 extends from an inner surface 62 of the body 14 on opposing sides of the opening 32. To provide the maximum stiffening and durability to the club head 12, the strut 50 should be integrally attached to the wall, such as by being welded in place, molded/comolded in place, or cast in place. In one configuration the strut 50 may be formed from a metal sheet having a uniform thickness 64 of from about 0.5 mm to about 1.5 mm (shown in FIG. 3), and a height 66 of from about 4 mm to about 25 mm. As generally shown in FIG. 5, while the strut 50 may be secured to the inner surface 62 of the sole 22 at a first end 67, in one embodiment it may be secured to the crown 26 at the opposing end 68 or at various places along its length.

Figure 6:
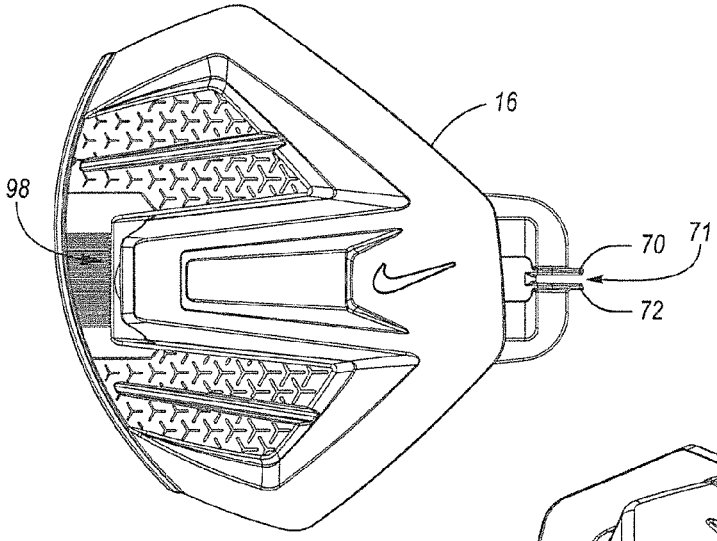
FIG. 6 is a schematic top view of an insert that is configured to be disposed in an opening provided in a body of a golf club head.
Figure 7:
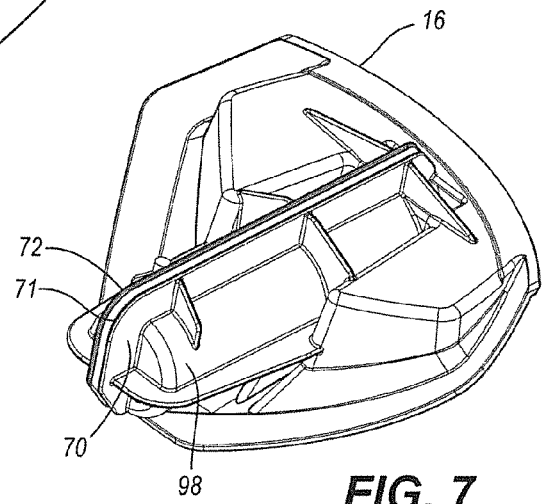
FIG. 7 is a schematic perspective view of the underside of the insert provided in FIG. 6.
Figure 8:
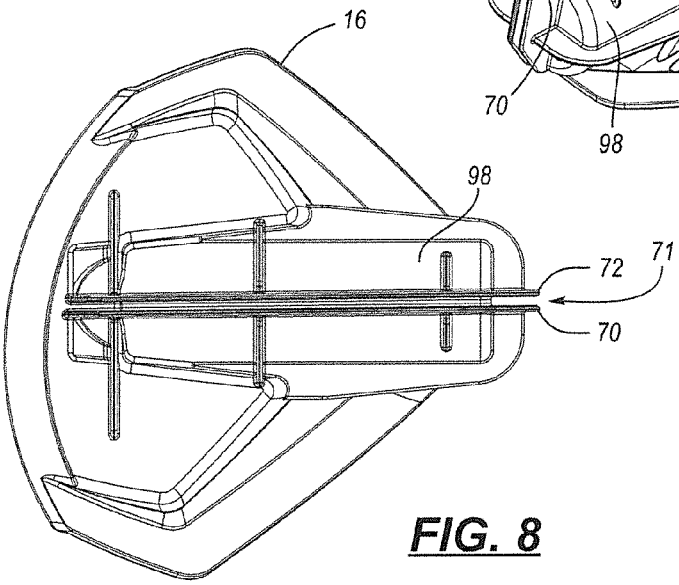
FIG. 8 is a schematic bottom view of the insert provided in FIG. 6.

In addition to stiffening the body structure, the support strut 50 may also assist in securing the insert 16 to the body 14. As shown in FIGS. 6-8, one embodiment of the insert 16 may include two, protruding walls 70, 72 that are spaced apart from each other to define a slot 71. The slot 71 is configured or dimensioned to receive a portion of the strut 50 when the two portions of the club head 12 are assembled/ brought into close contact. The slot 71 may be further configured or dimensioned so that the strut 50 may be adhered to each of the walls 70, 72 once it is positioned within the slot 71.

In the illustrated embodiment, the slot 71 may have a uniform width of, for example, from about 1.0 mm to about 2.0 mm. When the insert 16 is assembled with the body 14 and is in close contact with the bond surface 34, the protruding walls 70, 72 extend on opposing sides of the strut 50 and generally parallel to the stiffening plane 51. The inward-facing surfaces of these walls 70, 72 may be adhered to the strut 50 using, for example, the same adhesive that is used to secure the insert 16 to the outer bond surface 34. By adhering the insert 16 to both the strut 50 and the outer bond surface 34 of the body 14, the total surface area that is bonded between the insert 16 and the body 14 may be increased by more than about 30% above the outer bond surface 34, alone. Additionally, securing the insert 16 in this manner utilizes both the sheer strength of the adhesive (via the strut 50) and the tensile/peel strength of the adhesive (via the bond surface 34).

As mentioned above, one or more weights 18 may be selectively coupled with the body 14 and/or insert 16 to provide a user with an ability to alter the stock performance and weight distribution of the club head 12. As generally shown in FIG. 1, in one configuration, the weight 18 may generally include a generally cylindrical member 74 that may be removably secured within the golf club head 12. The weight 18 may be received and selectively retained within a bore 98 provided within the insert 16, where the bore is isolated from the interior clubhead volume. To properly reinforce the bore 98, particularly if the insert 16 is formed from a polymeric material, the slot 71 (and/or walls 70, 72 defining the slot 71) may be positioned such that the central stiffening plane (defined by the strut 50) bisects the bore 98 and/or weight 18. In a more preferred design, the stiffening plane would be oriented such that the plane intersects the center of gravity (COG) 78 of the weight, and any resultant impact force vectors would be within/parallel to the stiffening plane 51. Such a design may minimize any moments that may be applied through the polymer or lap joint. In general, the walls 70, 72 may generally be considered a "stiffening feature" that extend from the polymer forming the bore and are operative to structurally reinforce the bore 98.

Figure 9:
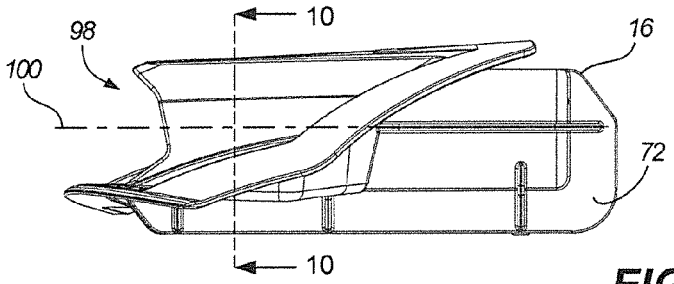
FIG. 9 is a schematic side view of the insert provided in FIG. 6.
Figure 10:
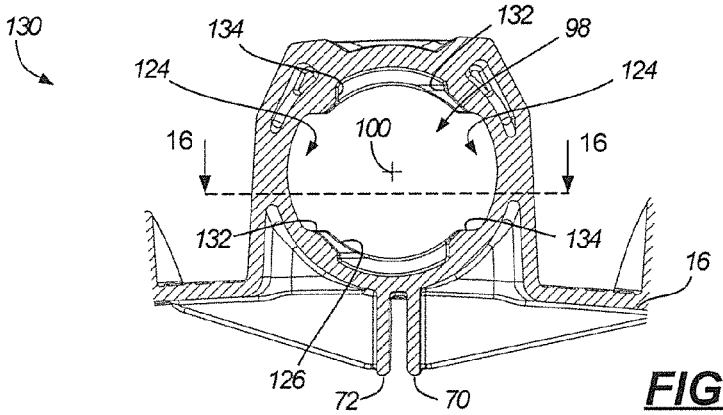
FIG. 10 is a schematic partial cross-sectional view of the insert provided in FIG. 9, taken along line 10-10.
Figure 11:
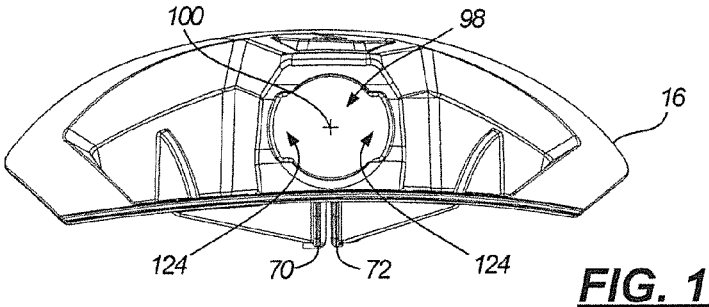
FIG. 11 is a schematic side view of the insert provided in FIG. 6.
Figure 13:
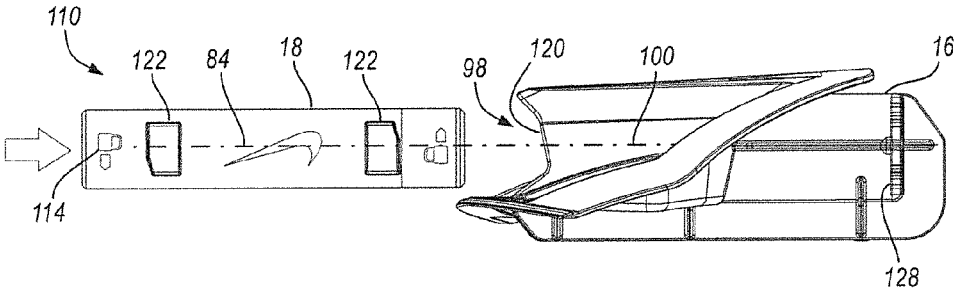
FIG. 13 is a schematic side view of a weight being inserted in a bore defined by an insert of a golf club head.

FIGS. 9-11 further illustrate an embodiment of the polymeric insert that defines the internal bore 98 or recess that is configured to receive and selectively retain the weight 18. The bore 98 may have a longitudinal axis 100, along which the weight 18 may slide while being inserted. The longitudinal axis 100 of the bore 98 may intersect the face 20 if extrapolated beyond the insert 16. As generally shown in FIG. 13, the longitudinal axis 84 of the weight 18 may be coincident with the longitudinal axis 100 of the bore 98 when the weight 18 is inserted into the bore 98.

In one configuration, the weight 18 may be reversible such that it may be inserted into the bore 98 in either a first orientation or in a second orientation. More specifically, in the first orientation, a first end 80 of the weight 18 may make initial entry into the bore 98 and may be more proximate to the face 20 than a second end 82 of the weight 18. In the second orientation, the weight 18 may be reversed such that the second end 82 of the weight 18 makes initial entry into the bore 98.

Reversing the orientation of the weight 18 within the club head 12, may have the effect of moving the COG of the club head 12 between a first location (corresponding to the first orientation) and a second location (corresponding to the second orientation). Due to the orientation of the bore 98, the motion of the COG between the first location and the second location would be along a line/axis that, if extrapolated, would intersect the face 20 of the club head 12. In one configuration, the net movement of the COG of the club head 12 that is caused by reversing the weight 18 would preferably be greater than about 2.0 mm. In another embodiment, the net movement of the COG caused by reversing the weight 18 is greater than about 2.5 mm.

In general, placing the COG of the club head 12 further away from the face 20 provides a greater dynamic loft angle than if the COG is closer to the face 20. Additionally, placing the COG further away from the face 20 will typically provide more of a draw-bias than if the COG is closer to the face 20 (which would comparatively provide more of a fade-bias). Therefore, by reversing the weight 18, a user may fine-tune the playing characteristics of the club head 12 to suit his/her particular interests and tendencies.

Figure 14:
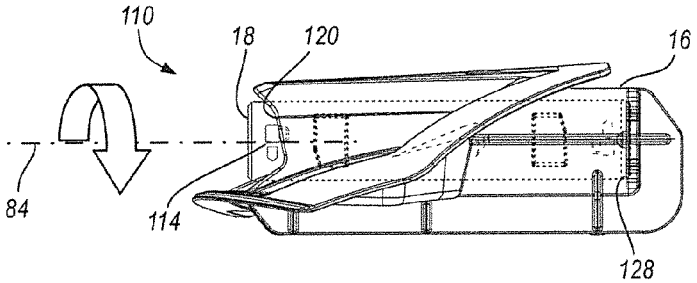
FIG. 14 is a schematic side view of a weight disposed in a first angular orientation within a bore of an insert.
Figure 15:
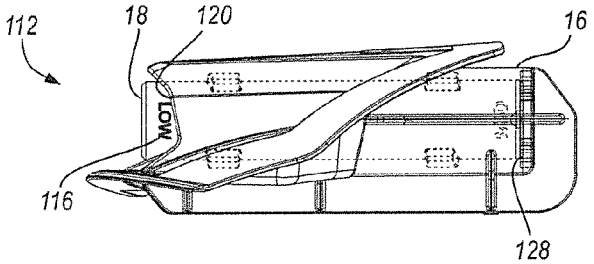
FIG. 15 is a side view of a weight disposed in a second angular orientation within a bore of an insert.
Figure 16:
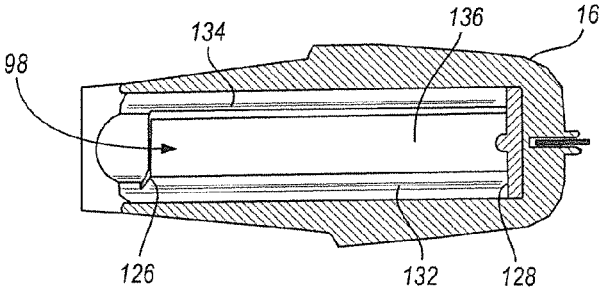
FIG. 16 is a schematic partial cross-sectional view of the insert of FIG. 10, taken along line 16-16.

Referring to FIGS. 13-15, once the weight 18 is inserted into the bore 98, as shown in FIG. 13, the weight 18 may be selectively secured into the club head 12 by rotating the weight 18 about its longitudinal axis 84 between a first angular position 110 (shown in FIG. 14) and a second angular position 112 (shown in FIG. 15) within the bore 98. In the first angular position 110, the weight 18 may be "unlocked" such that it may be free to be withdrawn from the bore 98. In the second angular position 112, the weight 18 may be "locked" such that it is selectively restrained within the bore 98.

In one configuration, the first angular position 110 and the second angular position 112 may be about 90 degrees apart from each other. In this manner, rotation of the weight 18 through ¼ turn may be all that is required to secure the weight 18 in place. In other embodiments, the first angular position 110 and second angular position 112 may be separated by an angular rotation of from about 90 degrees to about 270 degrees. In still other embodiments, the first angular position 110 and second angular position 112 may be separated by an angular rotation of more than about 270 degrees (e.g., such as a screw-style connection).

Referring to FIG. 14, when the weight 18 is fully inserted into the bore 98 and disposed in the first angular position 110, a first indicia 114 may be outwardly visible to a user. Conversely, after the weight 18 is rotated to the second angular position 112, the first indicia 114 may be hidden from view, and a second indicia 116 may be outwardly visible to the user. In one configuration, each of the first and second indicia 114, 116 may be respectively positioned on a different portion of a common circumference of the weight 18. The first indicia 114 and the second indicia 116 may each represent a different state of configuration for the weight 18. For example, the first indicia 114 may represent an unlocked state and the second indicia 116 may represent a locked state. Alternatively, if the weight is not symmetrically balanced about the longitudinal axis 84, the first indicia 114 may represent a first weight configuration (e.g., in a vertical plane) while the second indicia 116 may represent a second weight configuration.

In an embodiment where at least one of the first and second indicia 114, 116 represents an "unlocked" and/or "locked" state, the respective indicia may include a textual or graphical indicator, or alternatively a color indicator such as red or green. For example, as shown in FIG. 14, the first indicia 114 may include a graphic of a lock, together with a directional arrow that informs the user about which way to rotate the weight 18 to lock it in place. Once locked, the lock prompt may be hidden from view, and the user may then see the second indicia that provides information about how the club is configured and/or how the weight is oriented (i.e., "low" loft).

Transitioning between the first angular position 110 and the second angular position 112 may result in one of the first indicia 114 and the second indicia 116 being obfuscated or hidden by a portion of the insert 16. At the same time, the remaining indicia may then become visible through a viewing window or port provided in the insert. In one configuration, the viewing window may be a hole defined by the insert. In another configuration, as shown in FIGS. 13-14, the viewing window may be a recessed edge 120 of the bore 98, where a portion of the weight 18 extends proud of the recessed edge and one respective indicia is visible only adjacent to the recessed edge 120.

In one configuration, the weight 18 may be transitioned between the first and the second angular positions 110, 112 under the assistance or urging of a tool. As mentioned above, the tool may be configured to fit within the recess 96 provided in the weight 18 and to transmit a torque to the weight 18. The tool may be, for example, a star or hex wrench having a suitable handle for a user to grip and apply torque. In one configuration, the tool may be a torque-limited device that is capable of allowing a user to apply a force only up to a predetermined amount.

Figure 12:
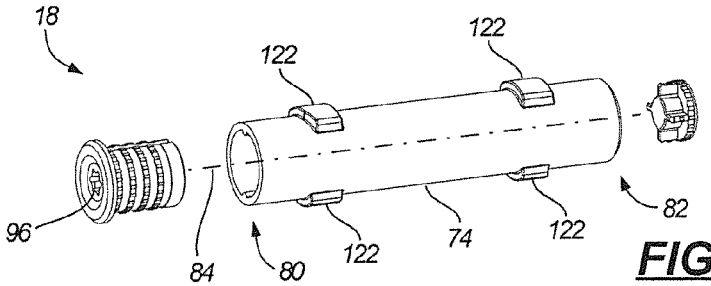
FIG. 12 is a schematic exploded perspective view of a weight that is configured to be selectively disposed in a golf club head.

FIGS. 10-16 illustrate one design of a locking mechanism that may be used to secure the weight 18 within the bore 98 by rotating it from the first angular position 110 to the second angular position 112. Referring to FIGS. 12 and 13, the weight 18 may include one or more radial protrusions 122 that extend outward from the elongate and/or cylindrical body 74. In another embodiment, the weight 18 may include two or more, or four or more radial protrusions 122 extending from the body 74, which may be equally spaced about the circumference. When inserted into the bore 98, the protrusions 122 may each freely slide in a longitudinal direction down a respective channel 124 provided in the bore 98 (shown in FIGS. 10-11). Once the weight 18 is fully inserted in the bore 98, a subsequent rotation of the weight 18 then causes at least one of the protrusions 122 to contact a cinching ramp 126, which extends into the bore 98 (shown in FIG. 10 and in the partial cross-sectional view provided in FIG. 16). The cinching ramp 126 includes a sloped portion that, as the respective protrusion 122 slides against it, exerts a longitudinally directed force against the weight 18/protrusion 122, and causes the weight to be drawn into the bore 98 and/or toward the face 20.

In one configuration, a dampening member 128 may be disposed at the end of the bore 98 that is opposite from threshold/opening of the bore 98. The dampening member 128 may include, for example, a deformable material that is elastically compressed when the weight 18 is drawn into the bore 98 via the cinching ramp 126. In one configuration, the dampening member 128 may include a gasket formed from a rubber or thermoplastic polyurethane material. In one embodiment, the gasket may have a hardness, measured on the Shore-A scale of from about 70A to about 90A. In another embodiment, the gasket may have a hardness, measured on the Shore-A scale of from about 80A to about 90A.

Once fully rotated into the second, locked angular position 112, the cinching ramp 126 may prevent the weight 18 from being directly removed from the bore 98 via its contact with the protrusion 122. The dampening member 128 is intended to firmly secure the weight 18 along a longitudinal direction by applying an elastic biasing force/pressure to the weight. Preventing relative movement between the weight 18 and the head 12 is important to prevent and/or greatly reduce any secondary impact forces that may be imparted by the weight 18 during a swing. To accomplish this, the dampening member 128 may be slightly thicker (along a longitudinal dimension of the bore) than a predefined tolerance between an end of the weight 18 and an end of the bore 98 when the protrusion 122 is in firm contact with the cinching ramp 126. More specifically, as the weight 18 is rotated into the second, locked angular position 112, the contact between the protrusion 122 and the cinching ramp 126 may cause the weight 18 to impinge into the dampening member 128. This impingement is preferably an elastic deformation/compression of the dampening member that results in a compressive spring force being applied to the weight 18. In one configuration, for a dampening member 128 having a hardness measured on the Shore A scale of 85 A, the various components may be dimensioned such that, when in a locked position, the weight 18 compresses the dampening member 128 by about 0.4 mm to about 1.0 mm, or alternatively, by about 15% to about 45% of an original thickness of the dampening member 128. If a material having a different hardness is used for the dampening member 128, the amount of compression may be adjusted to provide comparable biasing forces to what is disclosed herein.

To ensure that the weight 18 remains as positioned by the user, in one configuration, one or more rotational locking features may be provided that are adapted to restrain any rotational motion caused by a torque that is below a predetermined torque threshold. Referring to the cross-sectional view 130 provided in FIG. 10, one embodiment of such a rotational locking feature includes at least two stops 132, 134 that extend radially inward from an outer cylindrical portion 136 of the bore 98. These stops 132, 134 are positioned such that they are aligned with the rotational path of the protrusion 122 between the first and second angular positions 110, 112.

Under applied torque loads that are less than some predetermined torque, either of the stops 132, 134 may inhibit the rotation of the weight 18 by interfering with the angular motion of a corresponding protrusion 122. A larger torque load (i.e., over the predetermined torque) that is applied to the weight 18, however, may cause the insert 16 to elastically yield in an area that is proximate to the first stop 132 (i.e., in a manner similar to a compliant mechanism). By elastically yielding, the stop 132 may retract under the urging of the protrusion 122 and allow the protrusion 122 to pass, after which, it may return to its previous position. In one configuration, the predetermined torque is between about 10 inch-pounds and about 30 inch-pounds. For example, in one specific configuration, the predetermined torque may be about 20 inch-pounds. The predetermined torque may ultimately be a function of the resistance provided by the stop 132, along with the force required to compress the dampening member 128, and any frictional drag forces that may be present. In this manner, the first stop 132 may inhibit rotation only up to the predetermined torque (applied to the weight), and may compliantly retract from the path of the protrusion under larger applied torques. In one configuration, the geometry of the stop may be designed such that an applied torque above a first threshold is required to transition the weight into a locked state from an unlocked state, and a torque above a second threshold is required to transition the weight into an unlocked state from a locked state. In one configuration, the second threshold is greater than the first threshold, though each may be between about 10 inch-pounds and about 40 inch-pounds, or even between about 25 inch-pounds and about 40 inch-pounds. For example, in one configuration, the first threshold is about 30 inch-pounds, and the second threshold is about 36 inch-pounds.

While the insert 16 may be compliant in/around the first stop 132, in one configuration, the second stop 134 may be more rigid. For example, in one configuration, such as shown in FIG. 10, the second stop 134 may protrude a greater distance toward the center of the bore 98 than the first stop 132. In one configuration, the radial interference between the protrusion 122 and the first stop 132 may be about 0.5 mm, while the radial interference between the protrusion 122 and the second stop 134 may be about 1.0 mm. In addition to having differing interference heights (or alternatively), less compliance or no compliance may be designed into the insert 16 proximate to the second stop 134 to provide a more rigid stop.

Figure 17:
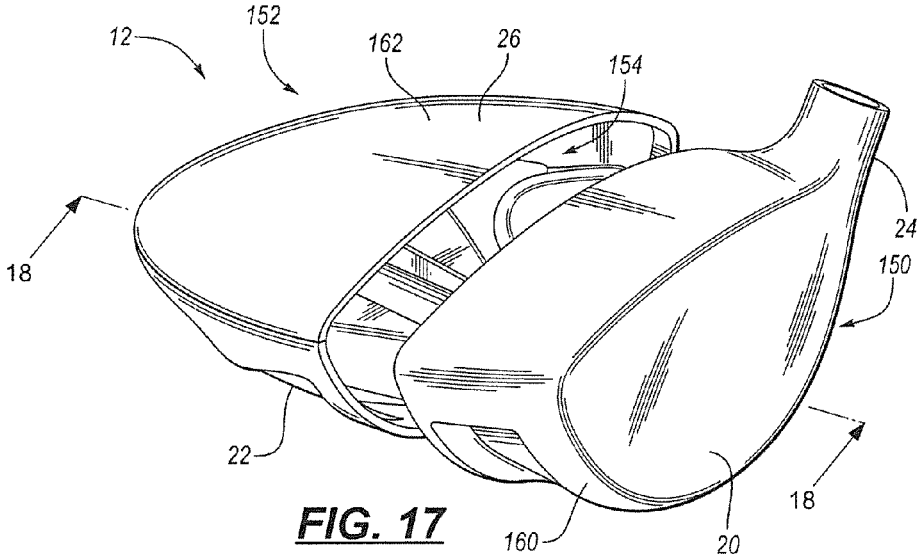
FIG. 17 is a schematic, partially exploded perspective view of a golf club head.
Figure 18:
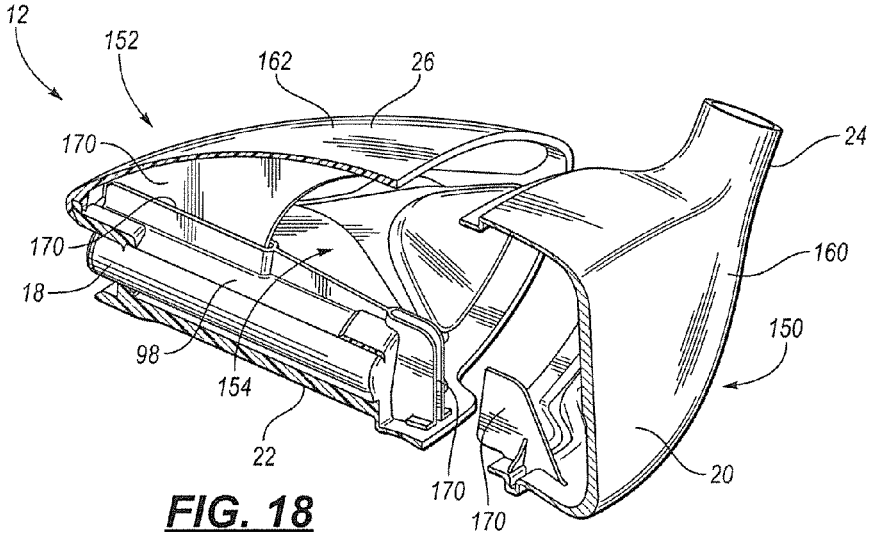
FIG. 18 is a schematic, cross-sectional view of the golf club head of FIG. 17, taken along line 18-18.

While FIGS. 1-16 schematically illustrate a first embodiment of how the present technology may be employed, FIGS. 17-18 schematically illustrate an alternate configuration. In each embodiment (including the embodiment shown in FIGS. 1-16), the golf club head 12 includes a first portion 150 that is rigidly adhered to a second portion 152 to at least partially define a closed interior volume 154 of the club head 12. As used herein, "rigidly adhering" is intended to mean a permanent fixation, whereby the respective components may not be separated through normal means without destroying or compromising the structural integrity of either part. In the embodiment shown in FIGS. 17-18, the first portion 150 may be a forward section 160 of the golf club head 12 that includes a face 20 and a hosel 24. The second portion 152 may then be a rear, body section 162 of the club head 12 that includes the majority of the crown 26 and sole 22. In the illustrated embodiment, the forward section 160 may, for example, be formed from a metallic alloy, while the rear, body section 162 may be formed from a filled or unfilled polymeric material similar to the insert 16 described above.

In a similar manner as described above, the golf club head 12 shown in FIGS. 17-18 includes a bore 98 that is defined by a polymeric portion 152 of the body 14. The bore 98 is operative to receive and selectively retain a weight 18, such as by rotating the weight about a longitudinal axis of the weight/bore (i.e., in conjunction with a locking mechanism, such as described above with respect to FIGS. 10-16).

By increasing the size of the polymeric portion 152, the structural weight of the club head 12 may be reduced, which enables more or heavier discretionary weights to be selectively located around the club head 12. While this is a benefit to the club design and potential customization, the increased use of polymer in this manner presents certain structural considerations that must be addressed. Similar to the designs described above with respect to FIGS. 4-5, the first and second portions 150, 152 may each have one or more stiffening features 170, such as one or more ribs or struts (i.e., including those that may define a slot therebetween) that may aid in providing structural rigidity to the club head 12. These same stiffening features 170 may further be useful in helping to adhere the polymeric portions to the metal portions by increasing the bonding surface areas. In one particular design, to stabilize the bore 98 and weight 18, it is preferable for a stiffening feature 170 to be formed in a manner where it extends outward directly from the bore 98. In a more preferable embodiment, a stiffening feature 170 may be disposed within a plane that is aligned to include the longitudinal axis of the bore 98. In either case, these ribs or other stiffening features 170 are most easily integrated into the polymeric portion 152 through an integral molding process, such as injection molding. Further detail on the stiffening features is provided in U.S. patent application Ser. No. 15/162,658, filed on May 24, 2016, which is incorporated by reference in its entirety.

While various embodiments have been described, the description is intended to be exemplary, rather than limiting and it will be apparent to those of ordinary skill in the art that many more embodiments and implementations are possible. Accordingly, the invention is not to be restricted except in light of the attached claims and their equivalents. Also, various modifications and changes may be made within the scope of the attached claims.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range. Each value within a range and the endpoints of a range are hereby all disclosed as separate embodiment. The terms "comprises," "comprising," "including," and "having," are inclusive and therefore specify the presence of stated items, but do not preclude the presence of other items. As used in this specification, the term "or" includes any and all combinations of one or more of the listed items. When the terms first, second, third, etc. are used to differentiate various items from each other, these designations are merely for convenience and do not limit the items.

The invention claimed is:

1. A golf club head comprising:

a first portion rigidly adhered to a second portion to at least partially define an interior club head volume;

wherein the first portion is formed from a metallic material and includes a face; and wherein the second portion is formed from a polymeric material and includes:

a wall defining a bore that is configured to receive and to selectively retain an elongate weight: and a stiffening feature integrally molded with the wall such that the stiffening feature extends outward from the bore.

2. The golf club head of claim 1, wherein the second portion includes a locking means for selectively retaining the elongate weight within the bore.

3. The golf club head of claim 1, wherein the stiffening feature is adhered to the first portion.

4. The golf club head of claim 1, wherein the polymeric material is a filled or unfilled thermoplastic polyamide.

5. The golf club head of claim 1, wherein the bore has a longitudinal axis; and wherein the longitudinal axis of the bore intersects the face.

6. The golf club head of claim 1, wherein the first portion is rigidly adhered to the second portion across a lap joint disposed therebetween.

7. A golf club head comprising:

a first portion rigidly adhered to a second portion to at least partially define an interior club head volume;

wherein the first portion is formed from a metallic material and includes a face;

wherein the second portion is formed from a polymeric material and includes:

a wall defining a bore that is isolated from the interior club head volume;

a means for selectively retaining a removable weight within the bore; and a stiffening feature integrally molded with the wall such that the stiffening feature extends outward from the bore.

8. The golf club head of claim 7, wherein the polymeric material is a filled or unfilled thermoplastic polyamide.

9. The golf club head of claim 7, wherein the stiffening feature is adhered to the first portion.

10. The golf club head of claim 7, wherein the bore has a longitudinal axis; and wherein the longitudinal axis of the bore intersects the face.

11. The golf club head of claim 7, further comprising a means for translating a center of gravity of the club head between a first location and a second location, wherein the first location and the second location are disposed along an axis that intersects the face.

12. The golf club head of claim 7, wherein the first portion is rigidly adhered to the second portion across a lap joint disposed therebetween.

13. A golf club head comprising:

a first portion rigidly adhered to a second portion to at least partially define an interior club head volume; and an elongate weight removably affixed to the second portion, the weight having a first end, a second end that is opposite the first end, and wherein each of the first end and the second end are disposed along a longitudinal axis of the elongate weight;

wherein the first portion is formed from a metallic material and includes a face; and wherein the second portion is formed from a polymeric material and defines a bore that is configured to receive and to selectively retain the elongate weight; and wherein the weight is insertable into the bore in either a first orientation or a second orientation such that the first end of the weight makes initial entry into the bore when inserted in the first orientation, and the second end of the weight makes initial entry into the bore when inserted in the second orientation.

14. The golf club head of claim 13, wherein the second portion includes a means for selectively retaining the elongate weight within the bore.

15. The golf club head of claim 14, wherein the second portion includes: a wall defining the bore; and a stiffening feature integrally molded with the wall such that the stiffening feature extends outward from the bore.

16. The golf club head of claim 15, wherein the stiffening feature is adhered to the first portion.

* * * * *